US009073365B2

(12) United States Patent
Satake

(10) Patent No.: US 9,073,365 B2
(45) Date of Patent: Jul. 7, 2015

(54) CONVEYOR DEVICE AND IMAGE FORMING APPARATUS

(71) Applicant: KYOCERA DOCUMENT SOLUTIONS INC., Osaka (JP)

(72) Inventor: Kenichi Satake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/167,542

(22) Filed: Jan. 29, 2014

(65) Prior Publication Data

US 2014/0210155 A1 Jul. 31, 2014

(30) Foreign Application Priority Data

Jan. 29, 2013 (JP) ..... 2013-013929
Jan. 27, 2014 (JP) ..... 2014-012383

(51) Int. Cl.

| | |
|---|---|
| ***B65H 5/22*** | (2006.01) |
| ***B41J 11/00*** | (2006.01) |
| ***B65H 5/06*** | (2006.01) |
| ***B65H 7/02*** | (2006.01) |

(52) U.S. Cl.

CPC ..... *B41J 11/007* (2013.01); *B41J 11/0085* (2013.01); *B65H 5/062* (2013.01); *B65H 5/224* (2013.01); *B65H 7/02* (2013.01); *B65H 2406/414* (2013.01); *B65H 2511/12* (2013.01); *B65H 2511/212* (2013.01); *B65H 2513/50* (2013.01); *B65H 2515/342* (2013.01); *B65H 2555/26* (2013.01); *B65H 2701/1311* (2013.01); *B65H 2701/1313* (2013.01)

(58) Field of Classification Search

CPC .. B65H 5/224; B65H 3/124; B65H 2406/411; B41J 11/0085
USPC ..... 271/276, 197, 196, 194, 108, 96
See application file for complete search history.

(56) References Cited

U.S. PATENT DOCUMENTS

| | | | | |
|---|---|---|---|---|
| 7,988,150 | B2 * | 8/2011 | Harney et al. | 271/276 |
| 8,182,080 | B2 * | 5/2012 | Kawakami et al. | 347/102 |
| 8,240,661 | B2 * | 8/2012 | Bober | 271/194 |
| 2011/0233848 | A1 * | 9/2011 | Kostudis et al. | 271/12 |
| 2012/0299236 | A1 * | 11/2012 | Fujita et al. | 271/96 |

FOREIGN PATENT DOCUMENTS

| | | | |
|---|---|---|---|
| JP | 2010-094870 | A | 4/2010 |
| JP | 2011-093639 | A | 5/2011 |

* cited by examiner

*Primary Examiner* — Luis A Gonzalez
(74) *Attorney, Agent, or Firm* — Studebaker & Brackett PC

(57) ABSTRACT

A conveyor device includes a support portion in which a through hole is formed and which is configured to support a to-be-conveyed medium; a negative pressure chamber configured to cause negative pressure to act on the to-be-conveyed medium through the through hole to suck the to-be-conveyed medium to the support portion; and a conveyance section configured to convey the to-be-conveyed medium sucked to the support portion. The negative pressure chamber includes a wall in which a communication hole to communicate the negative pressure chamber with the air is formed. The conveyor device further includes a shutter configured to slide on the wall of the negative pressure chamber to open/close the communication hole.

10 Claims, 11 Drawing Sheets

CONVEYOR DEVICE AND IMAGE FORMING APPARATUS

INCORPORATION BY REFERENCE

The present application claims priority under 35 U.S.C. §119 to Japanese Patent Application No. 2013-013929, filed Jan. 29, 2013 and Japanese patent Application No. 2014-12383, filed Jan. 27, 2014. The contents of these applications are incorporated herein by reference in their entirety.

BACKGROUND

The present disclosure relates to conveyor devices and image forming apparatuses including a conveyor device.

As devices to convey printing paper in inkjet printers, conveyor devices have been known which convey paper in a manner that the paper is sucked to an endless belt wound around a pair of tension rollers. A plurality of air holes are formed in the belt of the conveyor devices. A negative pressure generating device to cause negative pressure to act on the paper through the air holes is provided on the inner side of the belt in the radial direction. An inkjet head is provided on the outer side of the belt in the radial direction. The inkjet head ejects ink onto paper held on the outer peripheral surface of the belt to form an image on the paper.

The negative pressure generating device includes a fan case. A fan is provided in the fan case. A top plate of the fan case is in contact with the inner peripheral surface of the belt. The top plate supports the paper held on the outer peripheral surface of the belt through the belt from below of the belt. A plurality of suction holes extending in a conveyance direction are formed in the top plate. The suction holes in the top plate communicate the air holes of the belt with a negative pressure chamber in the fan case. Thus, the negative pressure in the fan case acts on the paper held on the outer peripheral surface of the belt through the air holes and the suction holes. As a result, the paper is sucked to the outer peripheral surface of the belt.

Alternatively, there is proposed a conveyor device that clips paper with the use of a conveyance roller pair to convey the paper without using the belt. This conveyor device directly sucks the paper to the top plate of the fan case through the suction holes. The conveyance roller pair conveys the paper in a state in which the paper is in contact with the top plate in a slidable manner.

The fan case is provided with an air releasing valve. When the air releasing valve is opened, the negative pressure chamber in the fan case communicates with the air to reduce the magnitude of the negative pressure in the fan case. Thus, the paper sucked through the suction holes is released. For example, the air releasing valve is so configured to turn inward of the fan case about its top end as a pivot axis from a fully closed state in which a communication hole is fully closed.

SUMMARY

A conveyor device according to the present disclosure includes: a support portion in which a through hole is formed and which is configured to support a to-be-conveyed medium; a negative pressure chamber configured to cause negative pressure to act on the to-be-conveyed medium through the through hole to suck the to-be-conveyed medium to the support portion; and a conveyance section configured to convey the to-be-conveyed medium sucked to the support portion. The negative pressure chamber includes a wall in which a communication hole to communicate the negative pressure chamber with the air is formed. The conveyor device according to the present disclosure further includes a shutter configured to slide on the wall of the negative pressure chamber to open/close the communication hole.

An image forming apparatus according to the present disclosure includes the above conveyor device and an image forming section which is arranged to face the support portion of the conveyor device and which is configured to form an image on the to-be-conveyed medium sucked to the support portion.

DETAILED DESCRIPTION

Figure 1:
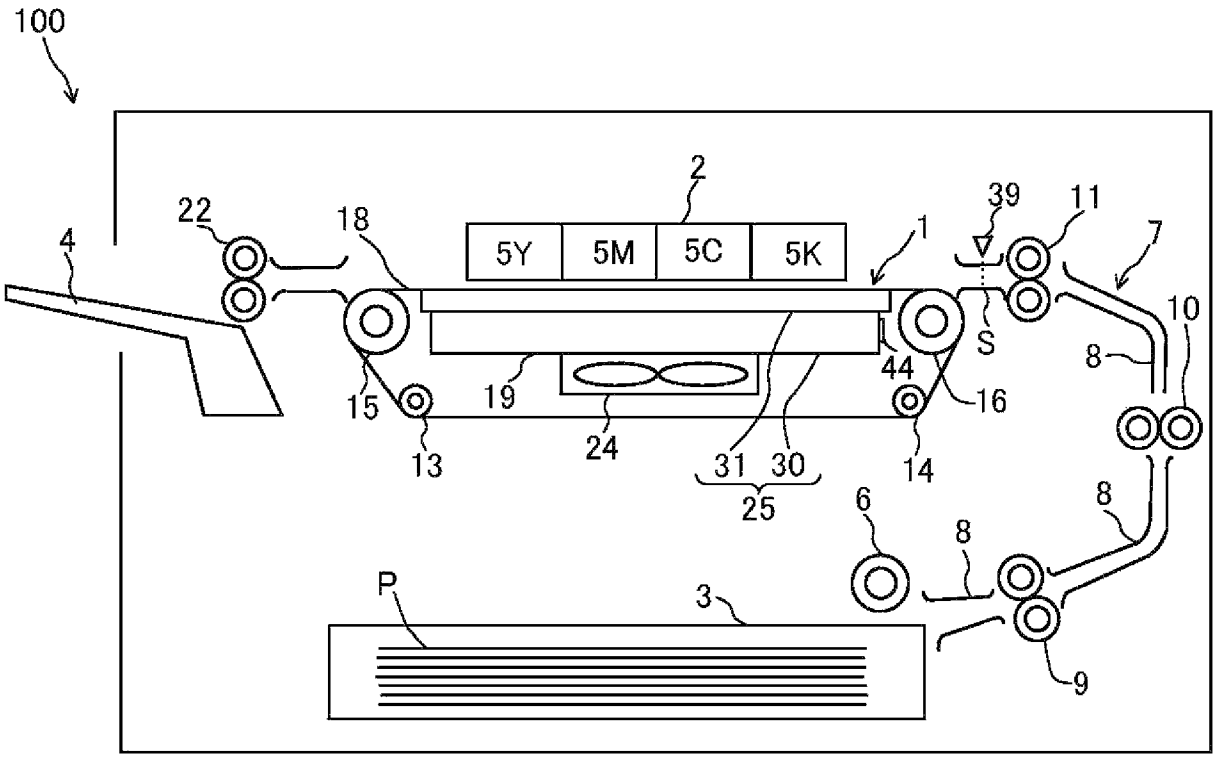
FIG. 1 is a cross sectional view showing an image forming apparatus including a conveyor device according to the first embodiment.

Embodiments of the present disclosure will be described in detail below with reference to the accompanying drawings. It is noted that the terms "upstream" and "downstream" in the following description mean upstream and downstream in a conveyance direction of a to-be-conveyed medium, respectively. Also in the present description, the term "magnitude of negative pressure" means an absolute value of a gage pressure (<0). The words "the magnitude of the negative pressure is large" means low gage pressure. The present disclosure is not limited to the following embodiments.

First Embodiment

First of all, description will be made with reference mainly to FIG. 1 about an overall configuration of an image forming apparatus 100 including a conveyor device 1 according to the present embodiment. The conveyor device 1 conveys paper P (to-be-conveyed medium).

An image forming apparatus 100 includes a conveyor device 1, an inkjet head 2, a paper feed cassette 3, and an exit tray 4.

The inkjet head 2 ejects ink to paper P (e.g., printing paper) to form (record) an image. The inkjet head 2 is movable along a guide rail extending in the main scanning direction (direction perpendicular to the paper of FIG. 1). The inkjet head 2 includes four line heads 5Y, 5M, 5C, 5K arranged in the sub scanning direction (right and left directions in FIG. 1). The line heads 5Y, 5M, 5C, 5K eject yellow (Y) ink, magenta (M) ink, cyan (C) ink, and black (K) ink, respectively. Multiple nozzles are formed for each line head 5Y, 5M, 5C, 5K at the lower surface of the inkjet head 2. Each line head 5Y, 5M, 5C, 5K changes the volume of its pressure chamber filled with the corresponding ink with the use of a piezoelectric element to eject the ink from the nozzles.

The paper feed cassette 3 accommodates paper P as a to-be-conveyed medium. The paper feed cassette 3 is provided in the lower part of the image forming apparatus 100. The paper feed cassette 3 can accommodate a plurality of sheets of paper P stacked. Further, the paper feed cassette 3 includes a slidable width restricting plate (not shown) for restricting widthwise movement of the paper P accommodated at a predetermined position in the paper feed cassette 3. A paper width sensor 48, which will be described later, is mounted on the width restricting plate.

The paper feed cassette 3 is provided with a paper feed roller 6 for paper feed. A conveyance path 7 to guide paper P in the paper feed cassette 3 to the conveyor device 1 is provided downstream of the paper feed roller 6. The conveyance path 7 is made up of guide plates 8. The conveyance path 7 is provided with a first conveyance roller pair 9, a second conveyance roller pair 10, and a registration roller pair 11 in this order from the upstream side to the downstream side. The first and second conveyance roller pairs 9, 10 convey paper P, which is fed from the paper feed cassette 3 to the paper feed roller 6, to the registration roller pair 11. The registration roller pair 11 sends the paper P to the conveyor device 1 with predetermined timing. A target sensor 39, which will be described later, is provided downstream of the registration roller pair 11.

The exit tray 4 is a tray onto which paper P, on which an image is formed, is to be ejected.

The conveyor device 1 is arranged to face the inkjet head 2. The conveyor device 1 is arranged under the inkjet head 2. The conveyor device 1 conveys the paper P fed from the registration roller pair 11 from the vicinity of the upstream end to the vicinity of the downstream end of the inkjet head 2. An ejection roller pair 22 and the exit tray 4 are provided downstream of the conveyor device 1.

The conveyor device 1 includes a drive roller 15, a driven roller 16, two tension rollers 13 and 14, a looped conveyance belt 18 wound around these four rollers 13-16, and a negative pressure generating device 19 provided inside the conveyance belt 18 in the radial direction.

The drive roller 15 is arranged downstream of the inkjet head 2. The drive roller 15 is a roller to transmit the drive force of a belt drive motor 50 (see FIG. 7) to the conveyance belt 18. The drive roller 15 is connected to the belt drive motor 50 (see FIG. 7) so as to be capable of transmitting the drive force. In the present embodiment, the belt drive motor 50 is a stepping motor. Further in the present embodiment, the belt drive motor 50 (see FIG. 7) and the drive roller 15 cooperate to function as a conveyance section.

The driven roller 16 is arranged upstream of the inkjet head 2. The driven roller 16 is arranged at substantially the same height as the drive roller 15.

Each of the tension rollers 13 and 14 is arranged under the drive roller 15 and the driven roller 16. The tension rollers 13 and 14 are used for adjusting the tension of the conveyance belt 18.

The top surface of the conveyance belt 18 corresponds to a conveyance surface for conveyance of paper P. The top surface of the conveyance belt 18 extends substantially in parallel with the lower surface of the inkjet head 2. The conveyance belt 18 conveys paper P while holding the paper P on the top surface of its own.

Figure 2:
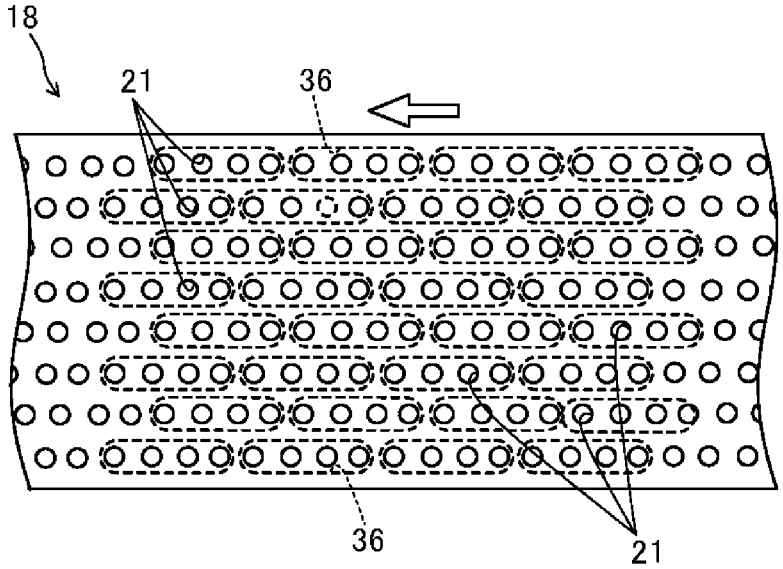
FIG. 2 is a plane view showing a conveyance belt of the conveyor device.

The conveyance belt 18 will be described below with reference mainly to FIG. 2. FIG. 2 is a plan view showing the conveyance belt 18 of the conveyor device 1.

As shown in FIG. 2, multiple air holes 21 are formed in the conveyance belt 18. Each air hole 21 passes through the conveyance belt 18 in the thickness direction of the belt. Each air hole 21 has a function of allowing the negative pressure generated in the negative pressure generating device 19 (see FIG. 1) to act on paper P.

With reference mainly to FIG. 1, description will be continued.

The negative pressure generating device 19 includes a fan case 25. The fan case 25 includes a case body 30 that opens upward and a thick top plate 31 that covers the top of the case body 30.

A fan 24 is mounted in the fan case 25. The fan 24 is mounted on the lower surface of the case body 30. The fan 24 generates the negative pressure in the interior of the fan case 25 by being driven by a fan drive motor 32 (see FIG. 7). The operation of the fan drive motor 32 is controlled by a controller 33, which will be described later. In the present embodiment, a negative pressure chamber 38 (see FIG. 6) is formed in the interior of the fan case 25.

The top plate 31 is in contact with the inner peripheral surface of the conveyance belt 18. The top plate 31 supports paper P held on the upper surface (outer peripheral surface) of the conveyance belt 18 from below with the conveyance belt 18 interposed therebetween. In the present embodiment, the conveyance belt 18 and the top plate 31 cooperate to function as a support portion.

Figure 3:
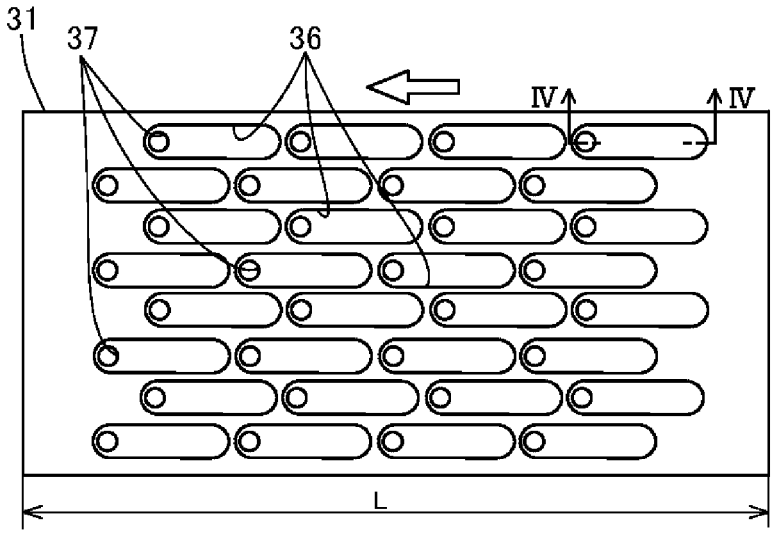
FIG. 3 is a plan view showing a top plate of a fan case.
Figure 4:
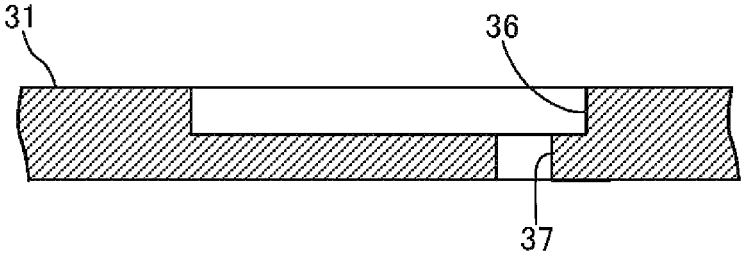
FIG. 4 is a cross sectional view taken along the line IV-IV in FIG. 3.

The top plate 31 will be described below with reference to FIGS. 3 and 4 in addition to FIGS. 1 and 2. FIG. 3 is a plan view showing the top plate 31 of the fan case 25. FIG. 4 is a cross sectional view taken along the line IV-IV in FIG. 3.

As shown in FIGS. 3 and 4, a plurality of slit grooves 36 extending in the conveyance direction of paper P are formed in the top surface of the top plate 31. Suction holes 37 vertically passing through the top plate 31 are formed in respective downstream end parts of the slit grooves 36. When the fan 24 is operated, the negative pressure is generated in the fan case 25. The negative pressure acts on paper P on the conveyance belt 18 through the suction holes 37 in the top plate 31 and the air holes 21 in the conveyance belt 18. Thus, the paper P is sucked to the upper surface of the conveyance belt 18.

Figure 5:
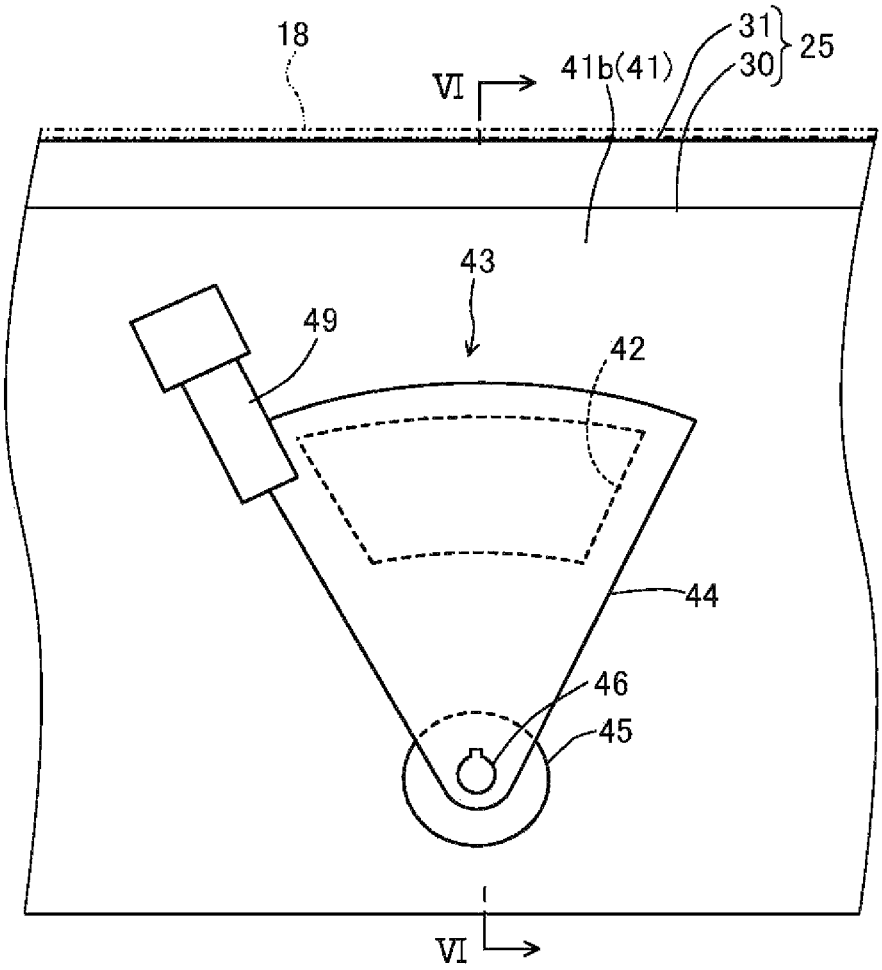
FIG. 5 is a view of an opening/closing device to open/close a communication hole in the fan case as viewed from the outside of the fan case.
Figure 6:
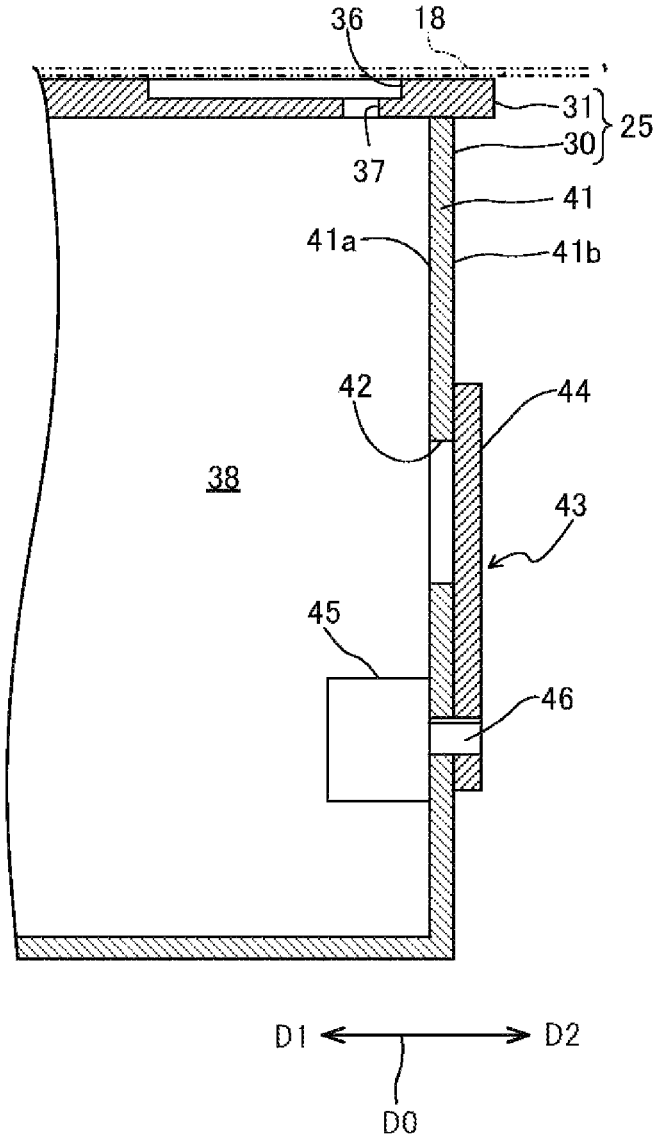
FIG. 6 is a cross sectional view taken along the line VI-VI in FIG. 5.

A configuration of an opening/closing device 43 will be described below with reference mainly to FIGS. 5 and 6. FIG. 5 is a view showing an opening/closing device 43 to open/close a communication hole in the fan case 25 as viewed from the outside of the fan case 25. FIG. 6 is a cross sectional view taken along the line VI-VI in FIG. 5. In FIG. 6, the line D0 indicates inward/outward directions of the fan case 25. The site D1 along the line D0 means the inside of the fan case 25, while the site D2 along the line D0 means the outside of the fan case 25.

A communication hole 42 is formed in a side wall 41 of the fan case 25 to communicate the negative pressure chamber 38 with the air. The communication hole 42 is capable of being opened/closed by the opening/closing device 43. It is noted that the communication hole 42 may be formed in, for example, a bottom wall of the fan case 25 rather than the side wall 41.

The opening/closing device 43 includes a shutter 44 to open/close the communication hole 42, a shutter drive motor 45 to drive to open/close the shutter 44, and an original point detection switch 49 to detect the position at which the shutter 44 is fully closed.

The shutter drive motor 45 is a stepping motor in the present embodiment. The shutter drive motor 45 is fixed at an inner wall surface 41*a* of the side wall 41 of the fan case 25. A rotary shaft 46 of the shutter drive motor 45 passes perpendicularly to and through the side wall 41 of the fan case 25. The tip end part of the rotary shaft 46 of the shutter drive motor 45 protrudes outward further than the side wall 41 of the fan case 25.

The shutter 44 is formed from a fan-shaped thin plate. The shutter 44 is fixed to the tip end part of the rotary shaft 46 of the shutter drive motor 45 so as to be turnable integrally with the rotary shaft 46 through key connection. The shutter 44 is in contact with an outer wall surface 41*b* of the side wall 41 of the fan case 25 so as to be slidable thereon.

FIG. 5 shows a state in which the shutter 44 fully closes the communication hole 42. When the rotary shaft 46 of the shutter drive motor 45 turns in the clockwise direction in FIG. 5 from this state, the shutter 44 slides on the outer wall surface 41*b*, while being turned in the clockwise direction in FIG. 5 along with the turning of the rotary shaft 46. Thus, the shutter 44 opens the communication hole 42.

By contrast, when the rotary shaft 46 of the shutter drive motor 45 turns in the anticlockwise direction in FIG. 5, the shutter 44 slides on the outer wall surface 41*b*, while being turned in the anticlockwise direction in FIG. 5 along with the turning of the rotary shaft 46. Thus, the shutter 44 closes the communication hole 42. It is noted that the operation of the shutter drive motor 45 is controlled by the controller 33, which will be described later.

Figure 7:
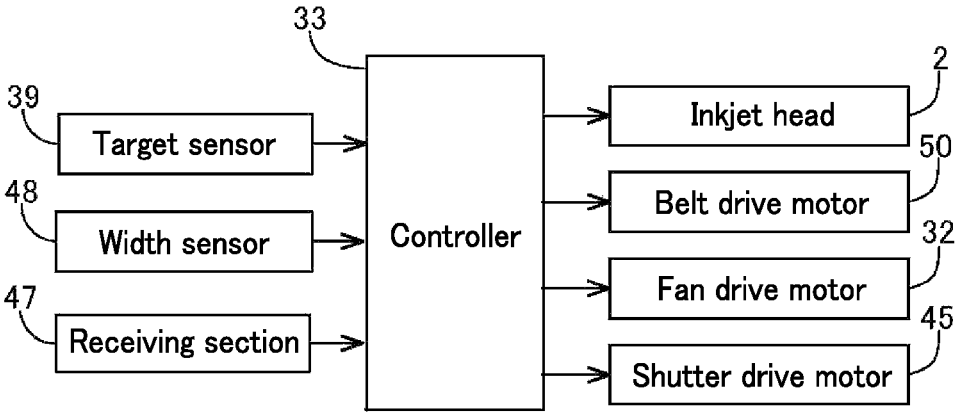
FIG. 7 is a block diagram showing a configuration of a control system of the image forming apparatus.

With reference mainly to FIG. 7, a control system configuration in the image forming apparatus 100 will be described below.

As shown in FIG. 7, the image forming apparatus 100 includes actuators, such as the inkjet head 2, the belt drive motor 50, the fan drive motor 32, and the shutter drive motor 45. The image forming apparatus 100 further includes the controller 33 to control each operation of the actuators. The controller 33 is formed from a microcomputer in which a CPU and memories (ROM and RAM) are built.

The controller 33 controls each operation of the inkjet head 2, the belt drive motor 50, the fan drive motor 32, the shutter drive motor 45, etc. on the basis of signals from the target sensor 39, the width sensor 48, and a receiving section 47.

The receiving section 47 receives an order from a user. The user can input order information to the receiving section 47 through an operation panel or a terminal personal computer (both not shown). The receiving section 47 outputs the input order information to the controller 33. The order information includes information on a paper feed mode in addition to image data information for printing and information on the number of copies.

As the paper feed mode, a normal paper feed mode or a serial paper feed mode is set in the controller 33 in the present embodiment. The normal paper feed mode is a mode of supply of paper P (paper feed) onto the top plate 31 on a sheet by sheet basis. The serial paper feed mode is a mode of supply of paper P onto the top plate 31 on a serial basis.

In the normal paper feed mode, succeeding paper P will not be supplied onto the top plate 31 until paper P being subjected to image formation has passed over the top plate 31. By contrast, in the serial paper feed mode, succeeding paper P is supplied onto the top plate 31 before paper P being subjected to image formation has passed over the top plate 31, so that an image is formed on the succeeding paper P. Plural pieces of paper P pass over the top plate 31 on the serial basis with a predetermined interval left from each other in the serial paper feed mode. The interval of the paper P is shorter than the length L of the top plate 31 in the conveyance direction (see FIG. 3) in the present embodiment.

The target sensor 39 may be a reflective optical sensor, for example. The target sensor 39 detects paper P passing over a detection point S in the vicinity of the upstream end of the top plate 31. Upon detection of paper P, the target sensor 39 outputs an ON signal to the controller 33. By contrast, during the time when the target sensor 39 detects no paper P, the target sensor 39 outputs an OFF signal to the controller 33.

The controller 33 detects the fact that the lead edge of paper P passes over the detection point S on the basis of the fact that the output signal from the target sensor 39 is switched from the OFF signal to the ON signal. By contrast, the controller 33 detects the fact that the rear edge of the paper P passes over the detection point S on the basis of the fact that the output signal from the target sensor 39 is switched from the ON signal to the OFF signal. In the present embodiment, the target sensor 39 and the controller 33 cooperate to function as a lead edge detection section and a rear edge detection section.

The width sensor 48 detects the width of paper P, on which an image is to be formed, and outputs a signal corresponding to the detected width to the controller 33.

The controller 33 controls each operation of the inkjet head 2 and the belt drive motor 50 on the basis of information from the receiving section 47. Thus, an image is formed (recorded) on the paper P.

Further, the controller 33 controls the operation of the shutter drive motor 45 on the basis of detection signals from the target sensor 39 and the width sensor 48. This controls the magnitude of the negative pressure in the fan case 25 (in the negative pressure chamber 38).

Description will be made with reference to FIGS. 1-7 about control by the controller 33 on each actuator. In the present embodiment, no difference in control by the controller 33 on the shutter drive motor 45 is made between in the normal paper feed mode and in the serial paper feed mode. Accordingly, the case where the normal paper feed mode is set in the controller 33 as the paper feed mode will be explained in the following description, unless otherwise specified. Description of the control by the controller 33 in the serial paper feed mode will be omitted.

Upon receipt of an instruction to start paper feed from the receiving section 47, the controller 33 outputs a control signal to the fan drive motor 32 to activate the fan 24, while outputting a control signal also to the shutter drive motor 45 to fully close the shutter 44.

The controller 33 detects the fact that the lead edge of paper P passes over the detection point S on the basis of the signal from the target sensor 39. Then, when a first time period Ta elapses after the lead edge of the paper P passes over the detection point S, the controller 33 outputs the control signal to the shutter drive motor 45 to drive to open the shutter 44. The wider the paper width detected by the width sensor 48 is, the more the controller 33 increases the driving amount of the shutter 44 (rotation amount of the shutter drive motor 45) in driving to open the shutter 44.

It is noted that the driving amount of the shutter 44 may be set so that the total area of the openings of air holes 21 being covered with the paper P out of the air holes 21 in the conveyance belt 18 is substantially in proportion to the open area of the communication hole 42 of the fan case 25 in a state in which the top plate 31 is covered with paper P over its entire length (e.g., in the state shown in FIG. 9C described later).

In the present embodiment, the time period from the time at which the lead edge of paper P passes over the detection point S to the time at which the magnitude of the negative pressure in the fan case 25 exceeds a predetermined threshold value K (see FIG. 10, which will be described later) is set as the first time period Ta on the assumption that no communication hole 42 is formed in the fan case 25. The wider the paper width is, the shorter the first time period Ta is.

In one example, each of the first time period Ta and the driving amount of the shutter 44 are converted to table data in association with the paper width and are stored in the ROM of the controller 33 in advance. On the basis of the signal from the width sensor 48 and the table data, the controller 33 determines the first time period Ta according to the width of paper P on which an image is to be formed.

On the basis of the signal from the target sensor 39, the controller 33 detects the fact that the rear edge of the paper P passes over the detection point S. Then, when a second time period Tb elapses after the rear edge of the paper P passes over the detection point S, the controller 33 outputs the control signal to the shutter drive motor 45 to drive to close (fully close in the present embodiment) the shutter 44.

In the present embodiment, the time period from the time at which the rear edge of paper P passes over the detection point S to the time at which the magnitude of the negative pressure in the fan case 25 falls below the predetermined threshold value K (see FIG. 10, which will be described later) is set as the second time period Tb on the assumption that no communication hole 42 is formed in the fan case 25. The wider the paper width is, the longer the second time period Tb is.

For example, the second time period Tb is converted to table data in association with the paper width and is stored in the ROM of the controller 33 in advance. On the basis of the signal from the width sensor 48 and the table data, the controller 33 determines the second time period Tb according to the width of paper P on which an image is to be formed.

With reference mainly to FIGS. 8-11, description will be made below about operation and advantages of the conveyor device 1 according to the present embodiment in comparison with a conveyor device with a fan case 25 in which no communication hole 42 is formed in the conveyor device 1 (hereinafter referred to as a conveyor device of a comparative example). Like numerals denote like elements shown in FIGS. 1-7 in each of the conveyor device 1 of the present embodiment and the conveyor device of the comparative example.

Figure 8:
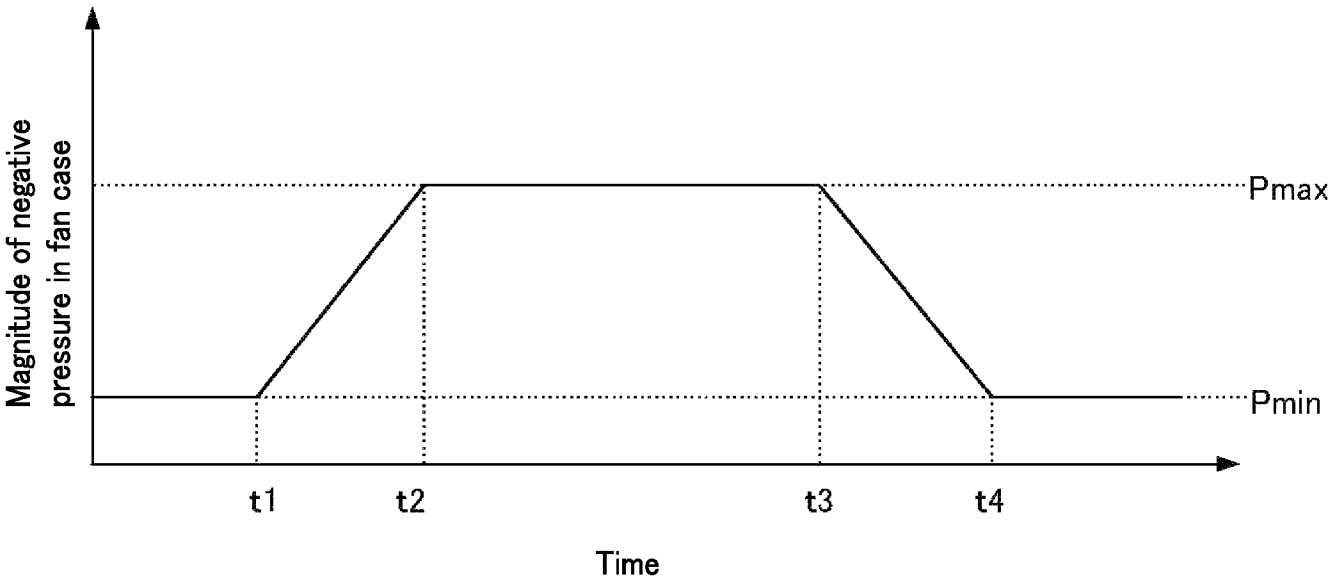
FIG. 8 is a graph representation showing time variation in magnitude of negative pressure in a fan case of a conveyor device with no opening/closing device.

FIG. 8 shows time variation in magnitude of the negative pressure in the fan case 25 of the conveyor device of the comparative example. FIGS. 9A-9D are illustrations each showing the positions where paper P is conveyed in respective time periods (before time t1, time periods between time t1 and t2, between t2 and t3, and between time t3 and t4 shown in FIG. 8).

Figure 9A:
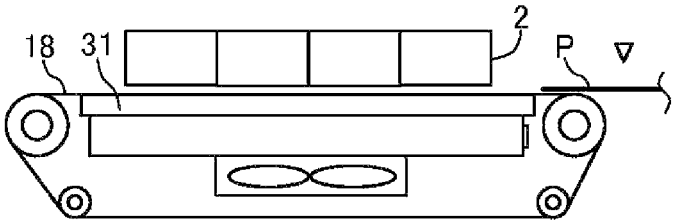
FIG. 9A is an illustration showing the conveyance position of paper before time t1 in FIG. 8.

Before the time t1 shown in FIG. 8, paper P is in a state before the lead edge of the paper P comes to the top plate 31, as shown in FIG. 9A. Accordingly, all the suction holes 37 formed in the top plate 31 are opened through the air holes 21 in the conveyance belt 18. Thus, the magnitude of the negative pressure in the fan case 25 is kept at a minimum value Pmin.

Figure 9B:
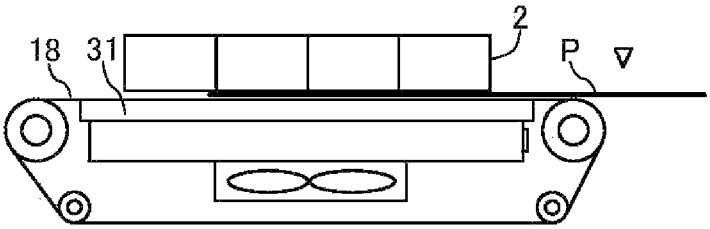
FIG. 9B is an illustration showing the conveyance position of the paper from the time t1 to time t2 in FIG. 8.

The paper P is coming above the top plate 31 together with the conveyance belt 18 in the time period between the time t1 and the time t2 shown in FIG. 8, as shown in FIG. 9B. Accordingly, as the conveyance belt 18 conveys the paper P downstream, the number of air holes covered with the paper P increases out of the air holes 21 (see FIG. 2) in the conveyance belt 18. In addition, the number of suction holes covered with the paper P also increases out of the suction holes 37 (see FIG. 3) in the top plate 31. Further, as the number of suction holes 37 covered with the paper P increases, the magnitude of the negative pressure in the fan case 25 increases. As a result, the magnitude of the negative pressure in the fan case 25 gradually increases, as shown in FIG. 8.

Figure 9C:
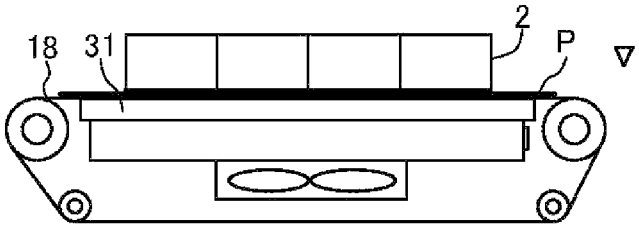
FIG. 9C is an illustration showing the conveyance position of the paper from the time t2 to time t3 in FIG. 8.

As shown in FIG. 9C, the top plate 31 is covered with the paper P over its entire length in the time period between the time t2 and time t3 shown in FIG. 8. Accordingly, the number of suction holes covered with the paper P out of the suction holes 37 (see FIG. 3) in the top plate 31 becomes constant. As a result, the magnitude of the negative pressure in the fan case 25 is kept constant at a maximum value Pmax, as shown in FIG. 8. It is noted that the larger the width of the paper P (length in a direction orthogonal to the conveyance direction) is, the larger the number of suction holes 37 covered with the paper P is. Thus, the maximum value Pmax is large (see the dashed and double dotted line in FIG. 11, which will be described later).

Figure 9D:
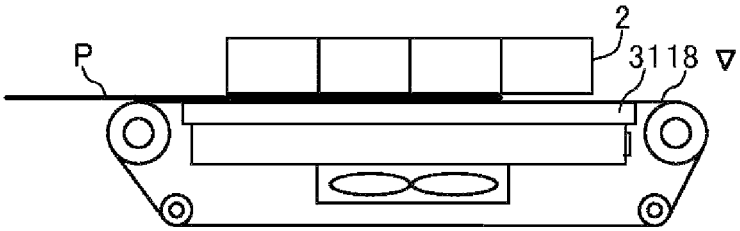
FIG. 9D is an illustration showing the conveyance position of the paper from the time t3 to time t4 in FIG. 8.

As shown in FIG. 9D, the rear edge of the paper P starts opening the air holes 21 in the conveyance belt 18 in the time period between the time t3 and the time t4 shown in FIG. 8. As the air holes 21 are opened, the suction holes 37 in the top plate 31 are also opened. As a result, the magnitude of the negative pressure in the fan case 25 gradually decreases, as shown in FIG. 8.

After the time t4 shown in FIG. 8, since the rear edge of the paper P has already passed over the top plate 31, all the suction holes 37 formed in the top plate 31 are opened through the air holes 21 in the conveyance belt 18 similarly to the time before the time t1 (see FIG. 9A). Accordingly, the magnitude of the negative pressure in the fan case 25 is kept at the minimum value Pmin (see FIG. 8).

Figure 10:
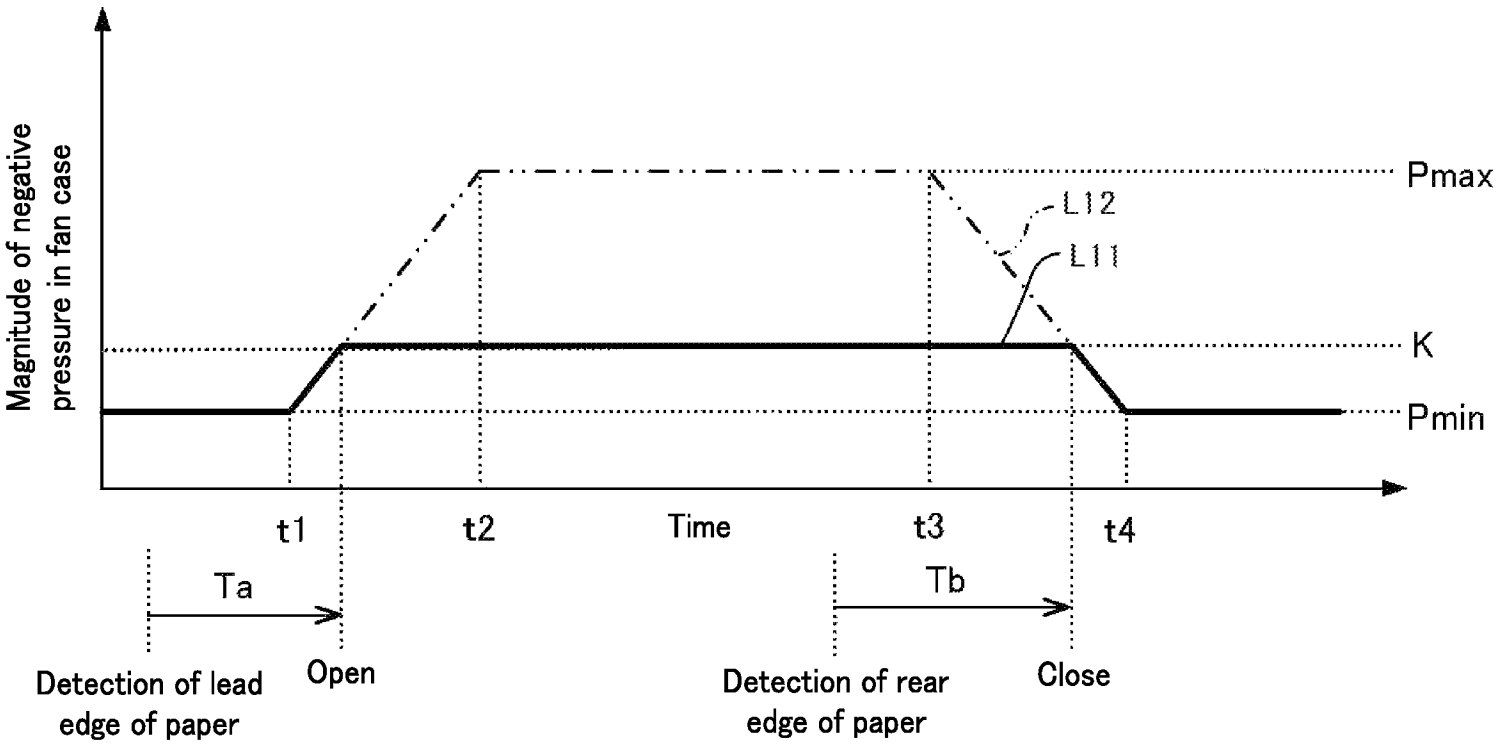
FIG. 10 is a graph representation showing time variation in magnitude of the negative pressure in the fan case of the conveyor device according to the first embodiment.

FIG. 10 is a graph representation showing each time variation in magnitude of the negative pressure in the fan cases of the conveyor device of the present embodiment and the conveyor device of the comparative example. In FIG. 10, the line L11 (solid line) indicates data of the conveyor device of the present embodiment, while the line L12 (dashed and double dotted line) indicates data of the conveyor device of the comparative example.

In order to reduce occurrence of failure to suck paper P, it is significant to cause the suction force to effectively act on the lead edge of the paper P when the paper P is coming above the top plate 31. For this reason, it is desirable to sufficiently increase the minimum value Pmin of the magnitude of the negative pressure in the fan case 25 (magnitude of the negative pressure in the fan case 25 when all of the suction holes 37 in the top plate 31 are opened) until the paper P comes above the top plate 31. However, as the minimum value Pmin is increased, the maximum value Pmax of the magnitude of the negative pressure in the fan case 25 increases accordingly. Too large maximum value Pmax (see the line L12 in FIG. 10, for example) may cause the suction force acting on the conveyance belt 18 to be excessive when compared to the suction force acting on the suction holes 37. As a result, the driving resistance of the conveyance belt 18 may increase to invite lowering of the accuracy in conveyance of paper P by the conveyance belt 18 or invite power swing of the belt drive motor 50.

In view of this, as indicated by the line L 11 in FIG. 10, the controller 33 (opening/closing controller) drives to open the shutter 44 when the first time period Ta elapses after the lead edge of the paper P passes over the detection point S (more specifically, from the time when the target sensor 39 (lead edge detection section) detects the fact that the lead edge of the paper P passes over the detection point S) in conveyor device 1 of the present embodiment. Thus, the magnitude of the negative pressure in the fan case 25 is controlled at the predetermined threshold value K. As a result, an excessive increase in magnitude of the negative pressure in the fan case 25 can be suppressed.

Further, in the conveyor device 1 of the present embodiment, the controller 33 (opening/closing controller) drives to close the shutter 44 when the second time period Tb elapses after the rear edge of the paper P passes over the detection point S (more specifically, from the time when the target sensor 39 (rear edge detection section) detects the fact that the rear edge of the paper P passes over the detection point S). Thus, an excessive decrease in magnitude of the negative pressure in the fan case 25 can be suppressed.

The shutter 44 of the conveyor device 1 according to the present embodiment is so configured to slide on the outer wall surface 41*b* of the side wall 41 of the fan case 25. In order to open/close the shutter 44 with this configuration, only required is to ensure drive force against the frictional resistance between the shutter 44 and the outer wall surface 41*b*. Accordingly, since it is unnecessary to drive the shutter 44 against the pressure difference between the inside and the outside of the fan case 25, the drive force to drive the shutter 44 can be reduced when compared with the case where the shutter 44 is opened/closed in the inward/outward directions of the fan case 25. Further, the driving mechanism for the shutter 44 can be reduced in size.

The shutter 44 of the conveyor device 1 according to the present embodiment is provided outside the fan case 25. With this configuration, the direction of the force by the negative pressure in the fan case 25, which acts on the shutter 44, agrees with the direction in which the shutter 44 is pressed against the outer wall surface 41*b* of the side wall 41 of the fan case 25. This can ensure the sealability to the fan case 25 in the state where all the suction holes 37 are opened (see FIG. 9A). In turn, the magnitude of the negative pressure in the fan case 25 can be sufficiently increased until paper P comes above the top plate 31. Accordingly, failure to suck paper P can be reduced reliably in the conveyor device 1 according to the present embodiment.

The conveyor device 1 of the present embodiment includes the rotary shaft 46 (shaft) provided perpendicularly to the side wall 41 of the fan case 25. The shutter 44 turns about the rotary shaft 46 to open/close the communication hole 42. This can simplify the driving mechanism for driving the shutter 44.

Figure 11:
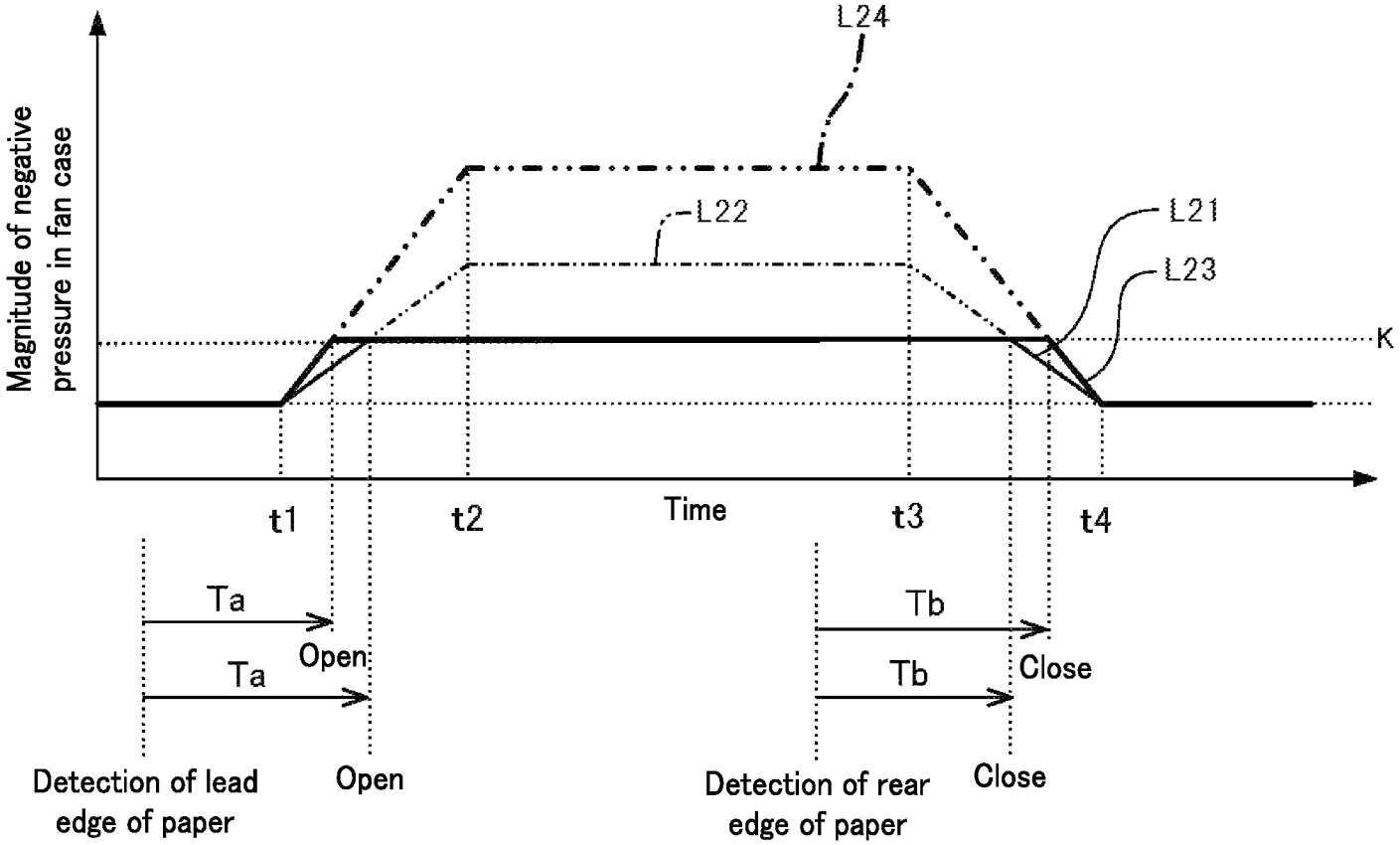
FIG. 11 is a graph representation showing each time variation in magnitude of the negative pressure in the fan case in the case using wide width paper and the case using narrow width paper for comparison.

FIG. 11 is a graph representation showing comparison of time variation in magnitude of the negative pressure in the fan case 25 between the case using wide width paper and the case using narrow width paper. The line L21 (thin solid line) and the line L22 (thin dashed and double dotted line) indicate data in the cases using narrow width paper (line L21: the present embodiment and line L22: the comparative example, respectively). The line L23 (thick solid line) and the line L24 (thick dashed and double dotted line) indicate data in the cases using wide width paper (line L23: the present embodiment and line L24: the comparative example, respectively).

In the conveyor device 1 of the present embodiment, the first time period Ta is set to the time period from the time when the lead edge of paper P passes over the detection point S to the time when the magnitude of the negative pressure in the fan case 25 exceeds the predetermined threshold value K on the assumption that no communication hole 42 is formed in the fan case 25. Further, in the conveyor device 1 of the present embodiment, the second time period Tb is set to the time period from the time when the rear edge of the paper P passes over the detection point S to the time when the magnitude of the negative pressure in the fan case 25 becomes below the predetermined threshold value K on the assumption that no communication hole 42 is formed in the fan case 25. As shown in FIG. 11, since the rates of increase and decrease of the magnitude of the negative pressure in the fan case 25 are gentle when the narrow width paper P is used in the conveyor device 1 of the present embodiment (see line L21), the first time period Ta is longer while the second time period Tb is shorter when compared with the case using the wide width paper P (see line L23).

As described above, the first and second time periods Ta and Tb are made different from each other according to the paper width. This can keep the magnitude of the negative pressure in the fan case 25 constant (at the threshold value K) regardless of the paper width. Thus, variation in magnitude of the negative pressure in the fan case 25 according to the paper width can be reduced, while the driving resistance of the conveyance belt 18 can be constant.

The controller 33 in the conveyor device 1 of the present embodiment is so configured to increase the driving amount of the shutter 44 in driving to close the shutter 44 as the width of paper P detected by the width sensor 48 is wide. Where wide width paper P is used in this configuration, the number of suction holes 37 covered with the paper P is larger than that in the case using the narrow width paper P. In turn, the degree of opening of the shutter 44 increases. This can reduce the difference in magnitude of the negative pressure in the fan case 25 between the case using the wide width paper P and the case using the narrow width paper P. Accordingly, variation in magnitude of the negative pressure in the fan case 25 according to the paper width can be reduced further reliably.

Moreover, in the conveyor device 1 of the present embodiment, opening/closing control on the shutter 44 by the controller 33 can be achieved by simple timing control based on the first and second time periods Ta and Tb. This can reduce an operation burden on the controller 33.

The image forming apparatus 100 according to the present embodiment includes the conveyor device 1 and the inkjet head 2 (image forming section) which is arranged to face the conveyance belt 18 (support portion) and which forms an image on paper P (to-be-conveyed medium) sucked to the conveyance belt 18. Thus, provision of the conveyor device 1 of the present embodiment in the image forming apparatus 100 can reduce failure to suck paper P. Further, occurrence of a paper jam or poor image formation can be reduced. In addition, the conveyance resistance of paper P can be reduced. Moreover, the conveyance accuracy of paper P can be increased. Furthermore, the quality of an image formed can be improved.

The image forming apparatus 100 according to the present embodiment ejects the ink from the inkjet head 2 (image forming section) to form an image on paper P (printing paper). Provision of the conveyor device 1 of the present embodiment in the image forming apparatus 100 can increase accuracy of conveyance of the paper P. Moreover, displacement of ink dots may be prevented.

Second Embodiment

Figure 12:
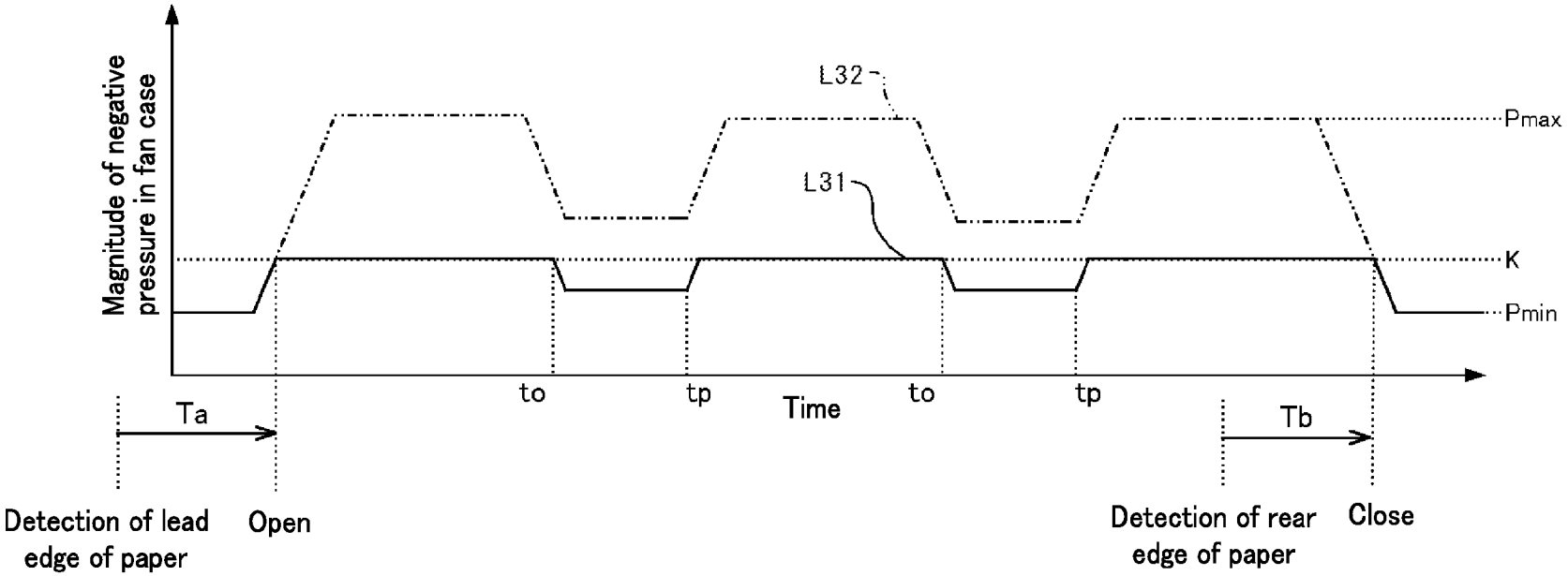
FIG. 12 is a graph representation showing time variation in magnitude of the negative pressure in a fan case of a conveyor device according to the second embodiment.

Referring mainly to FIG. 12, the second embodiment of the present disclosure will be described with the focus placed upon the difference from the first embodiment. Like numerals denote like elements shown in FIGS. 1-7. Duplicate description of the first embodiment shall be omitted or simplified.

FIG. 12 is a graph representation corresponding to FIG. 10 and shows time variation in magnitude of the negative pressure in a fan case 25 of a conveyor device according to the second embodiment. In FIG. 12, the line L31 (solid line) indicates data of the conveyor device of the second embodiment, while the line L32 (dashed and double dotted line) indicates data of the conveyor device of a comparative example.

The conveyor device of the second embodiment is different from that of the first embodiment in the opening/closing control on the shutter 44 in the serial paper feed mode. The opening/closing control on the shutter 44 in the normal paper feed mode is the same as that in the first embodiment. Hereinafter, the serial paper feed mode is set in the controller 33 as the paper feed mode, unless otherwise specified.

On the basis of the signal from the target sensor 39, the controller 33 in the present embodiment detects the fact that the lead edge of the foremost paper P passes over the detection point S. Then, when a first time period Ta elapses after the lead edge of the foremost paper P passes over the detection point S, the controller 33 outputs the control signal to the shutter drive motor 45 to drive to open the shutter 44.

On the basis of the signal from the target sensor 39, the controller 33 also detects the fact that the rear edge of the rearmost paper P passes over the detection point S. Then, when a second time period Tb elapses after the rear edge of the rearmost paper P passes over the detection point S, the controller 33 outputs the control signal to the shutter drive motor 45 to drive to close (fully close in the present embodiment) the shutter 44.

The first and second time periods Ta and Tb are set according to the paper width in advance similarly to, for example, those in the first embodiment. In one example, the first and second time periods Ta and Tb are set on the basis of timing when the magnitude of the negative pressure in the fan case 25 crosses the predetermined threshold value K on the assumption that no communication hole 42 is formed (dashed and double dotted line in FIG. 12).

With reference to FIG. 12, an operation and advantages of the conveyor device according to the present embodiment will be described next.

As shown in FIG. 12, when the first time period Ta elapses after the lead edge of the foremost paper P passes over the detection point S, the controller 33 drives to open the shutter 44. Thus, the magnitude of the negative pressure in the fan case 25 is controlled at the predetermined threshold value K. As a result, an excessive increase in magnitude of the negative pressure in the fan case 25 can be suppressed. In turn, the driving resistance of the conveyance belt 18 can be reduced.

Thereafter, when the lead edge of the paper P passes over an air hole 21 on the most downstream side in the conveyance belt 18 at time to, the magnitude of the negative pressure in the fan case 25 starts decreasing. When the succeeding paper P starts covering the air holes 21 of the conveyance belt 18, the magnitude of the negative pressure in the fan case 25 becomes constant. When the rear edge of the preceding paper P passes over the air hole 21 on the most downstream side in the conveyance belt 18 at time tp, the magnitude of the negative pressure in the fan case 25 changes to an increase. When the rear edge of the succeeding paper P covers an air holes 21 on the most upstream side in the conveyance belt 18, the magnitude of the negative pressure in the fan case 25 becomes constant again.

As described above, where succeeding paper P is present, the magnitude of the negative pressure in the fan case 25 will not excessively decrease even if the shutter 44 is not closed. The focus is placed upon this fact in the present embodiment. Accordingly, the controller 33 is so set to drive to close the shutter 44 after the second time period Tb elapses only after the fact that the rear edge of the rearmost paper P passes over the detection point S is detected. This can reduce unnecessary opening/closing of the shutter 44 to enable reduction in wearing out of the sliding part of the shutter 44.

Other Embodiments

The length of the paper P in the conveyance direction is longer than the length L of the top plate 31 in the conveyance direction in each of the above embodiments as one example. However, the present disclosure is not limited to this and is applicable to the case where the length of paper P in the conveyance direction is equal to or smaller than the length L of the top plate 31 in the conveyance direction, for example.

The conveyance belt 18 conveys paper P in each of the above embodiments. However, the present disclosure is not limited to this. The conveyance roller pairs may convey paper P without the use of the conveyance belt 18, for example. In this case, the top plate 31 of the fan case 25 functions as the support portion. The paper P is sucked directly to the top plate 31.

The conveyor device 1 in each of the above describe embodiments is applied to the image forming apparatus 100 of inkjet type as one example. However, the present disclosure is not limited to this. The conveyor device 1 may be applied to a laser printer, for example. In this case, the conveyor device 1 can be provided in a zone from transfer to fusing of toner to paper P.

The conveyor device 1 in each of the above described embodiments is applied to the image forming apparatus 100 as one example. However, the present disclosure is not limited to this and may be applicable to a conveyance line for paper P in a paper mill, for example.

The present disclosure is not limited to the above embodiments. For example, the present disclosure may have a configuration in appropriate combination of the above embodiments.

What is claimed is:

1. A conveyor device comprising:

a support portion in which a through hole is formed and which is configured to support a to-be-conveyed medium;

a negative pressure chamber configured to cause negative pressure to act on the to-be-conveyed medium through the through hole to suck the to-be-conveyed medium to the support portion; and a conveyance section configured to convey the to-be-conveyed medium sucked to the support portion, wherein the negative pressure chamber includes a wall in which a communication hole to communicate the negative pressure chamber with the air is formed, the conveyor device further comprising:

a shutter configured to slide on the wall of the negative pressure chamber to open/close the communication hole;

an opening/closing controller configured to control an opening/closing operation of the shutter; and a target sensor configured to detect the fact that a lead edge of the to-be-conveyed medium passes over a predetermined detection point located upstream of the support portion in a conveyance direction and detect the fact that a rear edge of the to-be-conveyed medium passes over the detection point, wherein the opening/closing controller drives to open the shutter when a first time period elapses from the time when the target sensor detects the fact that the lead edge of the to-be-conveyed medium passes over the detection point and drives to close the shutter when a second time period elapses from the time when the target sensor detects the fact that the rear edge of the to-be-conveyed medium passes over the detection point.

2. A conveyor device according to claim 1, wherein the shutter slides on an outer wall surface of the wall of the negative pressure chamber to open/close the communication hole.

3. A conveyor device according to claim 1, further comprising:

a shaft provided perpendicularly to the wall of the negative pressure chamber, wherein the shutter turns about the shaft to open/close the communication hole.

4. A conveyor device according to claim 1, further comprising:

a width detection section configured to detect a width of the to-be-conveyed medium, wherein the wider the width of the to-be-conveyed medium detected by the width detection section is, the shorter and the longer the opening/closing controller sets the first time period and the second time period, respectively.

5. A conveyor device according to claim 1, further comprising:

a width detection section configured to detect a width of the to-be-conveyed medium, wherein the opening/closing controller increases a driving amount of the shutter in driving to open the shutter as the width of the to-be-conveyed medium detected by the width detection section is wide.

6. A conveyor device according to claim 1, wherein at least part of the support portion forms a top plate of the negative pressure chamber.

7. A conveyor device according to claim 6, wherein the support portion includes a conveyance belt configured to convey the to-be-conveyed medium and the top plate which is in contact with an inner peripheral surface of the conveyance belt.

8. A conveyor device according to claim 1, further comprising:

a fan case, the negative pressure chamber being formed in an interior of the fan case.

9. An image forming apparatus comprising:

a conveyor device according to claim 1; and an image forming section which is arranged to face the support portion of the conveyor device and which is configured to form an image on the to-be-conveyed medium sucked to the support portion.

10. An image forming apparatus according to claim 9, wherein the to-be-conveyed medium is printing paper, and the image forming section includes an inkjet head and is configured to cause the inkjet head to eject ink to form an image on the to-be-conveyed medium.

* * * * *